United States Patent [19]

Unayama

[11] 4,205,498

[45] Jun. 3, 1980

[54] PARTITION WALL FASTENING UNIT

[76] Inventor: Koji Unayama, No. 19-4, 6-chome, Otsuka, Bunkyo-ku, Tokyo, Japan

[21] Appl. No.: 904,712

[22] Filed: May 10, 1978

[30] Foreign Application Priority Data

Aug. 4, 1977 [JP] Japan ..... 52-93029

[51] Int. Cl.[2] ..... E04B 2/72

[52] U.S. Cl. ..... 52/122; 52/238

[58] Field of Search ..... 52/122, 238, 240; 49/307

[56] References Cited

U.S. PATENT DOCUMENTS

| | | | |
|---|---|---|---|
| 1,311,127 | 7/1919 | Kendrick | 49/307 |
| 1,561,195 | 11/1925 | Szymkowiak | 49/307 |
| 2,949,983 | 8/1960 | Gartner | 52/238 X |
| 3,638,376 | 2/1972 | Howes et al. | 52/122 |

FOREIGN PATENT DOCUMENTS

| | | | |
|---|---|---|---|
| 847012 | 7/1970 | Canada | 52/238 |
| 549250 | 10/1956 | Italy | 49/307 |
| 274376 | 7/1927 | United Kingdom | 49/308 |

*Primary Examiner*—J. Karl Bell

*Attorney, Agent, or Firm*—Frank J. Jordan

[57] ABSTRACT

With an object to enable partition walls to be applied without any prior work in houses or buildings and to be removed without remaining an ugly appearance in houses or buildings, this partition wall fastening unit is provided with a sliding bed slidably disposed in a lower frame which is mounted on top of a partition wall, a pressing bed allowed to move up and down by links following a horizontal movement of the sliding bed, and an upper frame flexibly supported by the pressing bed to be urged against a ceiling, when a drive mechanism causes the sliding bed to push up the pressing bed which further pushes up the upper frame, after the partition wall fastening unit is applied to a partition wall placed at a position in houses or buildings where a specific layout therein requests the partition wall to be located.

4 Claims, 19 Drawing Figures

PARTITION WALL FASTENING UNIT

The present invention relates to partition wall fastening units to be utilized for application of partition walls to houses or buildings, when the space therein is partitioned following a variety of requests regarding the layout thereof.

It is not seldom to build buildings or houses of which each floor is remained completely without partition or with very little partition, because it is convenient for meeting the specific request of residents or tenants concerning the layout of the space thereof following their specific objects to use the space thereof. Further, this will readily allow remodeling of the layout, such request is inclined to frequently happen afterwards.

In the prior art, panel type partition walls are fitted to either ceilings or floors or walls through fitting parts which are bolted with insert beds which are from the beginning embedded in slabs forming structural parts of buildings or houses. This means that the selection of layout is extremely limited, when the panel type partition wall in the prior art is utilized, because such a wall can be fitted only at the place where insert beds have been embedded from the beginning.

When a remodeling is requested for a layout, it becomes necessary to embed insert beds at different places following the revised layout. This means that the insert beds which were from the beginning embedded will have to be given up. This will usually remain ugly spots on the surface of ceiling, floor and wall, after spending a considerable amount of money. Further, cases may be that some of the specific layout will be difficult to implement in the event that some of the specific place do not allow insert beds to be embedded due to the unexpected existance of some type of obstacles such as stones at the same specific place. In addition, it is to be noted that workmen will be requested to take a hard posture during the period in which they carry out this type of work.

As an improvement, a method which utilizes air pressure has been proposed. A pair of frames consisting of an upper and a lower frames and containing an airtight bag made of a resilient material therein, is mounted on top of a partition wall. The resilient airtight bag pushes the upper frame against the under surface of a ceiling, when it is inflated with the air blown into the bag. Since this method relies predominantly on the air pressure in the bag, however, it is not necessarily reliable due to the inherently unavoidable deterioration of the resilient material which forms the bag. Further, this type of partition walls has much possibility to cause a variety of unexpected accidents.

Accordingly, every method available in the prior art is not satisfactory from the viewpoints of the various requirements such as conveniency in application and removal of the partition walls, less expensive cost for application work and flexibility in meeting a variety of required layouts.

A general object of the present invention is to provide a partition wall fastening unit which allows an easy application to houses or buildings without requiring any prior work to be applicable to ceiling, floor or wall and also allows an easy removal from houses or buildings without remaining any ugly appearance on ceiling, floor or wall.

A further object of the present invention is to reduce the cost of application and/or removal of partition walls.

A further object of the present invention is to provide a partition wall fastening unit which is flexible in meeting a variety of requested layouts.

An additional object of the present invention is to provide a partition wall fastening unit which is durable for a long period.

With a variety of objects discribed in the immediate above, the partition wall fastening unit in accordance with the present invention is provied with a sliding bed and a pressing bed of which the both are connected each other and are arranged to urge upward an upper frame against a ceiling to fasten a partition wall between the ceiling and a floor with a durable and satisfactory reliability without requiring any prior work applicable to houses or buildings, when a drive mechanism is operated to cause the both beds to urge the upper frame, after the partition wall fastening unit is mounted on the partition wall standing on a floor at a place where a partition is requested. Since the partition wall fastening unit in accordance with the present invention does not use any material on which the future deterioration will have to be taken into account, it is sufficiently durable for a long period. Since the partition wall fastening unit can be removed with ease, no ugly appearance will be remained on ceiling, floor or wall after the removed. Utilization of a sound-proof cover supplements the effect of sound-proofing inherently owned by a partition wall. Further, the partition wall fastening unit may be utilized for application of the side and rear flanks to built-in furniture and for fastening the storing units.

Figure 1:
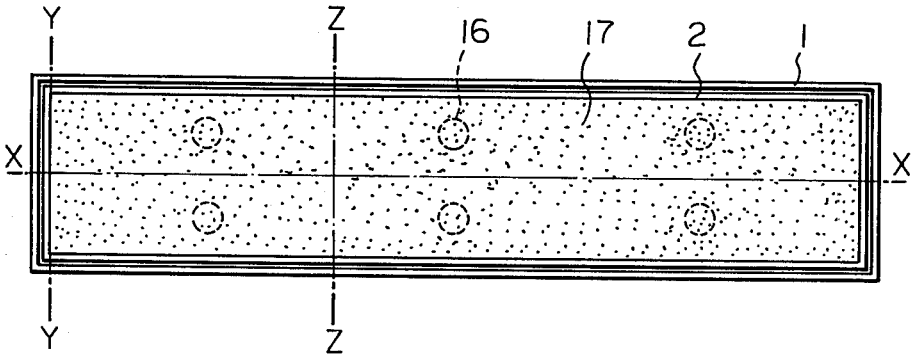
FIG. 1 is a plan view of a preferred embodiment of the partition wall fastening unit in accordance with the present invention.

Referring to FIGS. 1 through 4 of the drawings which show a prefered embodiment of a partition wall fastening unit in accordance with the present invention, reference numeral 1 is a lower frame having a U shape cross section defining a cover, and 2 an upper frame having a U shape cross section and accommodated in the lower frame 1. A sliding bed 3 and a pressing bed 4 are disposed between the upper frame 2 and the lower frame 1. The upper frame 2 is allowed to vertically move up and down, and the sliding bed 3 is allowed to horizontally move. The pressing bed 4 and the sliding bed 3 are connected each other by a plurality of links 5, allowing the sliding bed 3 to push the pressing bed 4 upward, when the sliding bed 3 is horizontally moved to the left along the bottom surface of the lower frame 1. The number of links may be arbitrarily determined in dependence on the magnitude of pressure to be applicable between a ceiling and the partition wall fastening unit. Indicated as 8 is a bracket rigidly fitted on one end of the sliding bed 3 by some proper means such as welding, and with an opening for screw 9 penetrating the sliding bed 3 from side to side. It is of course possible to integrate the bracket 8 and the sliding bed 3. Indicated as 10 is a bracket arranged at one end of the lower frame 1. An opening 11 formed in the bracket 10 allows a bolt 12 to reach an opening 9 formed in the bracket 8 where the bolt 12 is screwed with the bracket 8. A bolt stopper 13 is located between the bracket 8 and the bracket 10 indicated as 14 is a recess in which the head of the bolt 12 is held. Inidcated as 15 is a plurality of spring supporting rods. The upper end of each spring supporting rod 15 is rigidly fitted to the lower surface of the upper frame 2 by some proper means such as welding, and the lower end of each spring supporting rod 15 suspends the pressing bed 4. Since compression springs 16 are arranged along the spring supporting rod 15 between the lower surface of the upper frame 2 and the upper surface of the pressing bed 4, the pressing bed 4 urges the compression springs 16 upward for thereby raising the upper frame 2 to fix the partition wall between the ceiling and the floor. Indicated as 17 is a spacer placed between the upper surface of the upper frame 2 and the ceiling 19. Indicated as 18 is a hole formed in the side wall of the lower frame 1 for inspection of the inside thereof.

Figure 5:
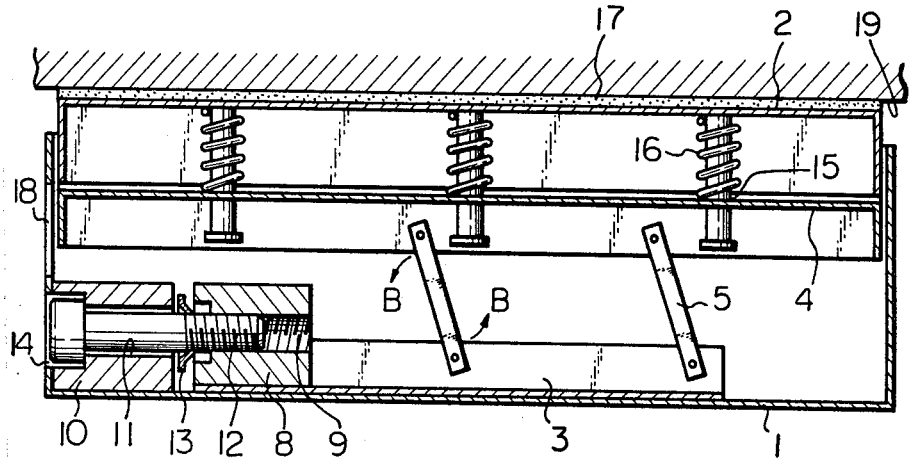
FIG. 5 is a sectional view of the partition wall fastening unit showing the view in an operated position.

FIG. 5 is a sectional view of the partition wall fastening unit showing a state in which the pressing bed 4 is raised to cause the upper frame 2 to urge the ceiling 19 through the spacer 17.

Figure 2:
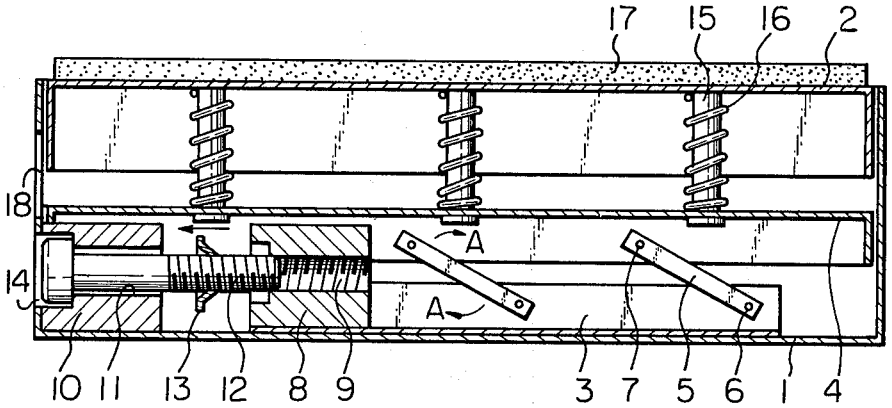
FIG. 2 is a sectional view of the partition wall fastening unit shown in FIG. 1 taken on the chain line X—X shown in FIG. 1.
Figure 3:
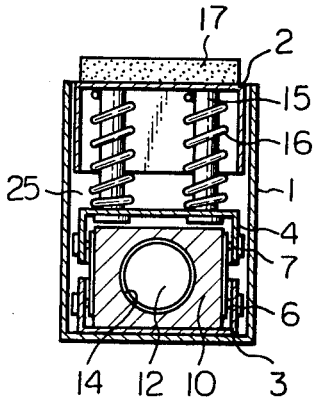
FIG. 3 is a sectional view of the partition wall fastening unit shown in FIG. 1 taken on the chain line Y—Y shown in FIG. 1.
Figure 4:
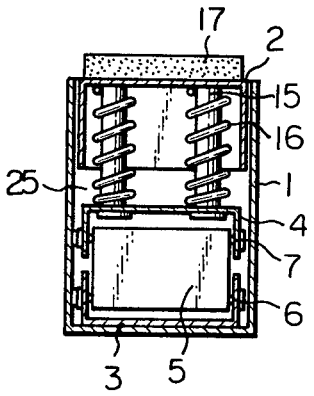
FIG. 4 is a sectional view of the partition wall fastening unit shown in FIG. 1 taken on the chain line Z—Z shown in FIG. 1.

Described below is a process to reach the position shown in FIG. 5 from the position shown in FIG. 2. When the bolt 12 is rotated clockwise by means of a tool such as a wrench (not shown in the drawings), the bracket 8 as well as the sliding bed 3 is pulled towards the bracket 10. Incidentally, the links 5 which are clockwise rotated by the sliding bed 3 push up the pressing bed 4. Since the number of the links 5 is more than one, the upper surface of the pressing bed 4 is kept in parallel with the upper surface of the lower frame 1. Even in the case where the lower surface of the ceiling 19 is not in parallel with the upper surface of the lower frame 1, the upper surface of the upper frame 2 is kept in parallel with the lower surface of the ceiling 9 by assistance of the compression springs 16. In other words, the difference in distance between the lower surface of the ceiling 19 and the upper surface of the upper frame 2 is adjusted by the corresponding difference in deformation of the compression springs 16. As a result, even in the case where the lower surface of the ceiling 19 is not in parallel with the upper surface of the lower frame 1, the upper surface of the upper frame 2 is urged uniformly against the lower surface of the ceiling 19. In addition, it is possible to adjust the compression pressure between the lower surface of the ceiling 19 and the upper surface of the upper frame 2 by selection of the strength and number of the compression springs 16. Further, when the sliding bed 3 is fitted at a position where the pressing bed 4 does not urge the upper frame 2, it is possible to float it with a constant pressure applied therein. In this case, since it makes a flexible construction, it is capable to absorb any strain such as expansion or contraction due to earthquakes or aging.

Following description discusses the position in which the partition wall fastening unit is put into the practical application.

Figure 6:
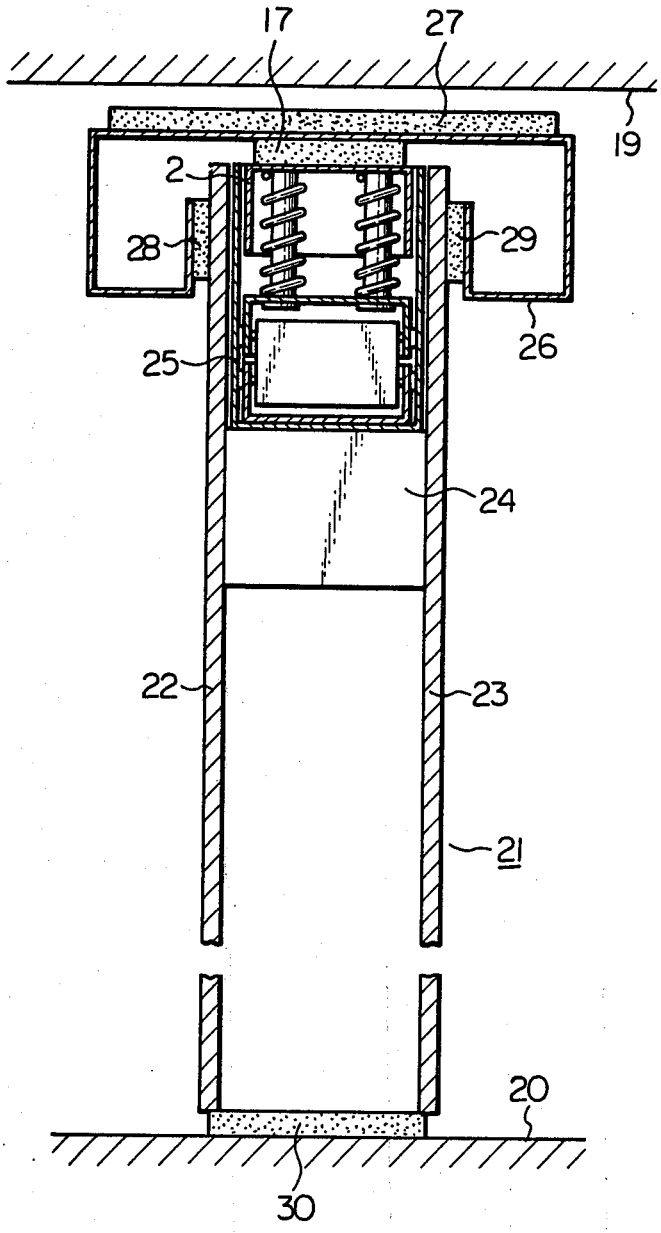
FIG. 6 is a vertical sectional view showing a position in which the partition wall fastening unit as well as a sound-proof cover is mounted in a recess defined on top of a partition wall standing on a floor and below a ceiling.

FIG. 6 is a vertical sectional view showing a position in which the partition wall fastening unit as well as a sound-proof cover is mounted in a recess defined on top of a partition wall standing on a floor and below a ceiling. Referring to FIG. 6 of the drawings, indicated as 20 is the surface of a floor, and a partition wall 21 includes a front panel 22 and a rear panel 23 holding a core 24 between the two panels. Indicated as 25 is a recess defined on top of the partition wall 21, and the partition wall fastening unit is placed in the recess 25. Indicated as 26 is a sound-proof cover which is placed on the spacer 17 which is further placed on the upper surface of the upper frame 2. The other spacer 27 is placed between the lower surface of the ceiling 19 and the upper surface of the sound-proof cover 26. It is possible to form the spacer 27 either in one body as shown in FIG. 6 or in a pair of split bodies each of which is placed on either end of the sound-proof cover 26. The another set of spacers 28 and 29 are arranged between the sound-proof cover 26 and the front and rear panels 22 and 23 respectively. Indicated as 30 is another spacer which is disposed between the bottom of the partition wall 21 and the floor 20.

Figure 7:
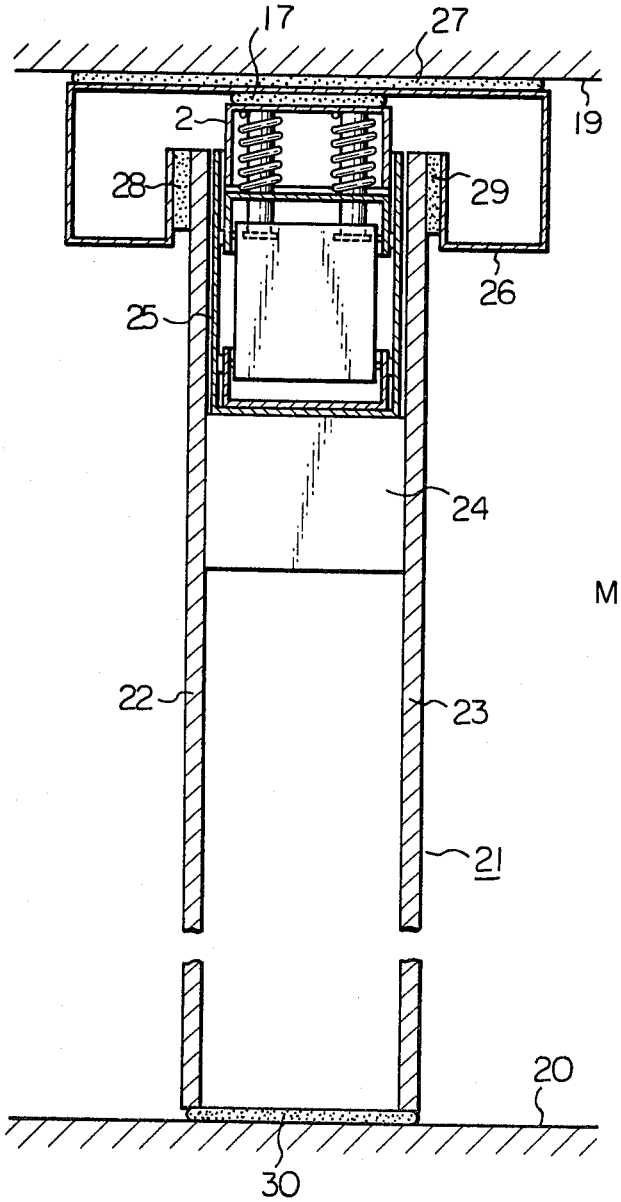
FIG. 7 is a vertical sectional view showing a position in which the partition wall fastening unit as well as a sound-proof cover is applied to a partition wall to fasten the latter between a ceiling and a floor.

When the partition wall is put into application, the partition wall 21 is mounted with the partition wall fastening unit placed in the recess on top of the wall 21 and with the sound-proof cover 26 disposed between the fastening unit and the ceiling. As described in the above with reference to FIGS. 1 and 5, a rotation of the bolt 12 causes the sliding bed 3 to slide whereby the pressing bed 4 is moved upward to raise the upper frame 4 until the upper frame 4 contacts with the ceiling 19 and urges the sound-proof cover 26 and the spacer 27 against the ceiling 19. The final position is as shown in FIG. 7.

Figure 8:
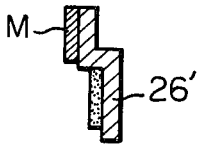
FIG. 8 is a sectional view of a modification of the sound-proof cover to be utilized in combination with the partition wall fastening unit.

The sound-proof cover 26 may be substituted by a frame attached with a magnet M, as shown in FIG. 8, arranged on the upper frame 2.

The above mentioned operation is continued until the partition is completed for the entire floor to implement a specific layout in houses or buildings.

The final unit completing a linear series of partition is a modified one with a recess from which the operation is possible for rotation of the bolt 12. The recess is closed after the application work is completed for the partition wall fastening units.

The process for removing the partition wall 21 will be described below. Referring to FIG. 5, an counter clockwise rotation of the bolt 12 causes the bracket 8 and the sliding bed 3 to move away from the bracket 10 against the tension of the compression spring 16. In this action, the bolt stopper 13 is effective to prevent the bolt 12 from coming out of the bolt hole 11. The rightward slide of the sliding bed 3 causes the links 5 to rotate, in the direction of the arrow B shown in FIG. 5, and allows the pressing bed 4 to slide downward along the flank of the lower frame 1. This looses the urging pressure between the upper frame 2 and the ceiling 19, allowing an easy removed of the partition wall 21.

Figure 9:
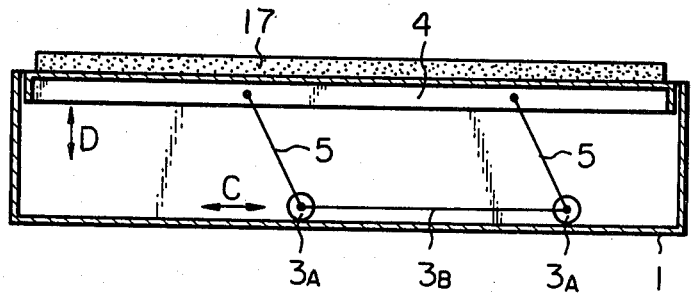
FIG. 9 is a partly sectional view of another embodiment of the partition wall fastening unit in accordance with the present invention.

FIG. 9 is a sectional view of another embodiment of a partition wall fastening unit in accordance with the present invention. Referring to FIG. 9, a combination of rollers 3A and connecting rods 3B substituting the sliding bed 3 is connected with the pressing bed 4 by a pair of links 5. A drive means similar to that which is utilized for the embodiment shown in FIGS. 1 through 7 (not shown in FIG. 9) slides the combination of the rollers 3A and the connecting rods 3B from side to side in the direction of the arrow C, causing the pressing bed 4 to move upward and downward, resulting in the same final effects as those attained in the embodiment shown in FIGS. 1 through 7. As is utilized in this embodiment, the pressing bed 4 may be directly mounted with the spacer 17 rather than through the upper frame 2 and the compression springs 16 arranged around the spring supporting rods 15, causing simplicity in construction and economization in production cost.

Figure 10:
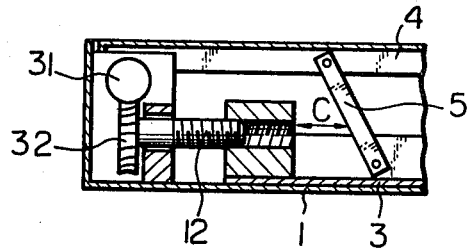
FIG. 10 is a partly sectional view of a modification of the drive mechanism to be comprised with the partition wall fastening unit in accordance with the present invention.

FIG. 10 is a fragmentary, sectional view of a modification of the drive mechanism for the partition wall fastening unit in accordance with the present invention. Referring to FIG. 10, a rotation of a worm gear 31 causes a rotating of a worm wheel 32 and further a rotation of a bolt 12, which slides the sliding bed 3 from side to side in the direction of the arrow C and causes the links 5 to move the pressing bed upward and downward. This enables a manual operation from the position facing the front or back of the partition wall rather than from the position facing the edge of the partition wall, eliminating the recess which is indispensable for the embodiment shown in FIGS. 1 through 7.

Figures 11, 12:
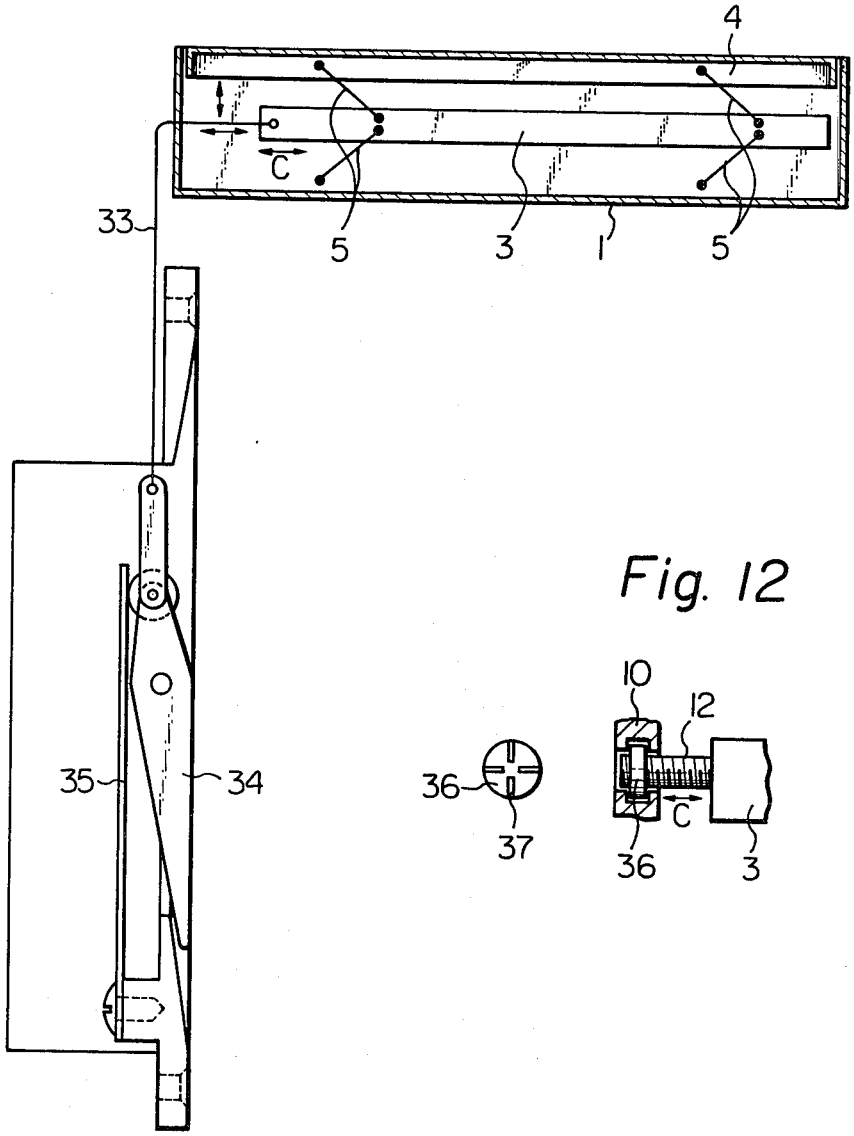
FIG. 11 is a partly sectional view of another embodiment of the partition wall fastening unit in accordance with the present invention attached with an enlarged schematic view showing another modification of the drive mechanism.
FIG. 12 is a partly sectional view showing another modification of the drive mechanism to be comprised with the partition wall fastening unit in accordance with the present invention.
Figure 14:
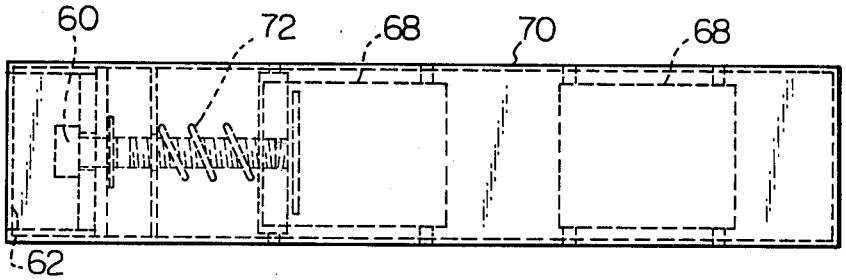
FIG. 14 is a plan view of another preferred embodiment of a fastening unit according to the present invention.

FIG. 11 is a partly sectional view of another embodiment of the partition wall fastening unit in accordance with the present invention. Referring to FIG. 11, the slidings bed 3 and the pressing bed 4 are arranged in the lower frame 1, and two different groups of links 5 rotatably connect the lower frame 1 with the sliding bed 3 and the sliding bed 3 with the pressing bed 4 respectively. The sliding bed 3 is driven by a wire 33 and a drive mechanism consisting of a lever 34 which pulls the wire 33 and the sliding bed 3 to move the pressing bed 4 upward and downward, and a leaf spring 35 which holds the lever 34 at either an upper position or a lower position. This shortens the time required for application and removed of the partition wall fastening unit.

FIG. 12 is a partly sectional view showing another modification of the drive mechanism to be compressed with the partition wall fastening unit in accordance with the present invention. Referring to FIG. 12, a recess is defined in the bracket 10 in which a rotatable nut 36 having a plurality of a cross-shaped recesses 37 is disposed. The bolt 12 screwed with the nut 36 which is driven by means of a tool to be fitted with the cross-shaped recess 37, is allowed to move the sliding bed 3 back and forth, resulting in the same effects as for the embodiment shown in FIGS. 1 through 7.

Figure 13:
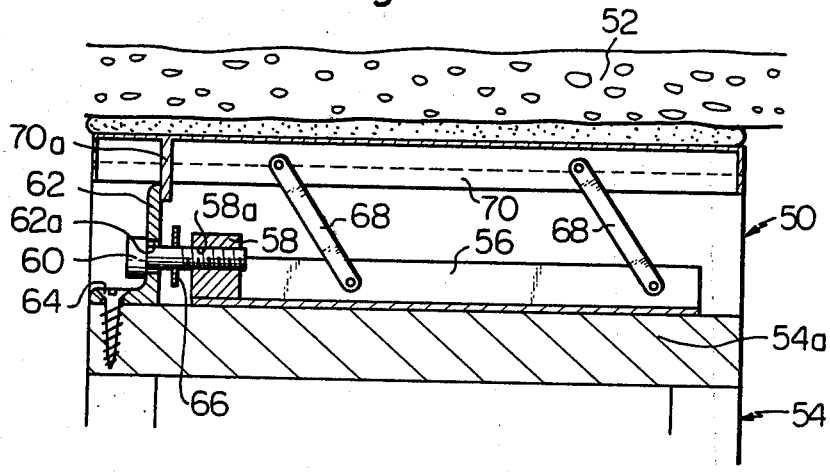
FIG. 13 is a cross sectional view of another preferred embodiment of a fastening unit according to the present invention.

FIG. 13 shows another preferred embodiment of a partition wall fastening unit according to the present invention with the unit being shown as being applied to a window frame. In FIG. 13, the fastening unit is mounted between a ceiling 52 and a window frame assembly 54 and comprises a sliding bed 56 which is slidably disposed on an upper frame **54*a* of window frame assembly 54. The sliding bed 56 has at its left end provided with a head 58 having formed therein a threaded bore 58*a* extending in a horizontal direction. A portion of a bolt 60 is screwed into the threaded bore 58*a* of the head 58 to slidably move the sliding bed 56 rightward or leftward. The bolt 60 extends through a bore 62*a* of a flange 62 secured to the upper frame 54*a* at an extreme end thereof. Connected to an intermediate portion of the bolt is s stopper 66 which prevents excessive leftward movement of the bolt 60. A pair of links 68 each in the form of a plate are connected between the sliding bed 56 and a pressing bed 70 which has a vertical guide 70*a* adapted to be slidably guided by the flange 62 during raising and lowering movement of the pressing bed 70. The fastening unit 50 thus arranged operates in the same manner as previously described with reference to previous embodiments to fixedly support the window frame assembly 54 to the ceiling 52**.

Figure 15:
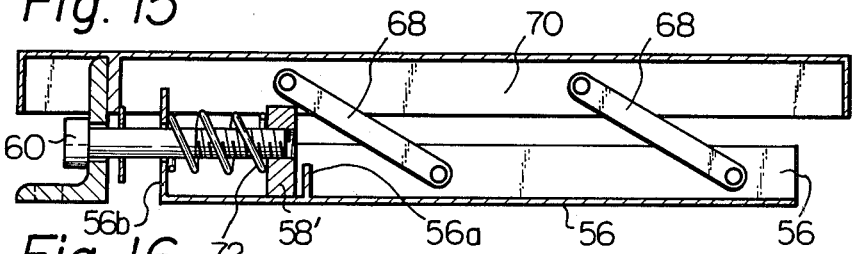
FIGS. 15 to 17 are cross sectional views of the unit shown in FIG. 14.
Figure 16:
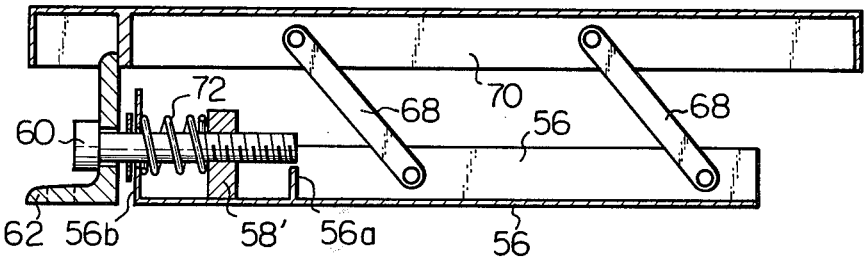
Figure 17:
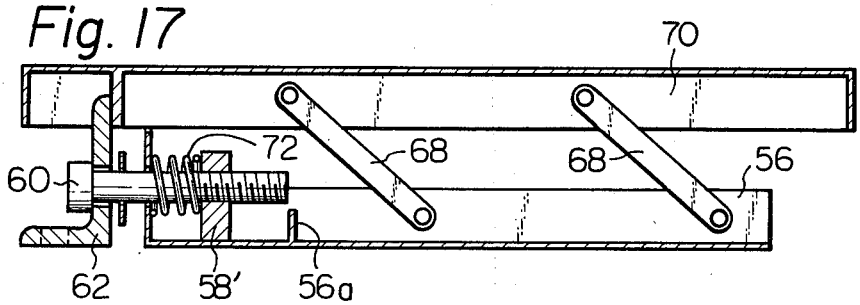

FIGS. 14 to 17 show another preferred embodiment of a fastening unit according to the present invention, with the same reference numerals indicating the same component parts as shown in FIG. 13. The fastening unit disclosed in FIGS. 14 to 17 is similar in construction as that shown in FIG. 13 except that the unit is also provided with a compression spring 72 to resiliently support the partition wall or window frame assembly against the ceiling. As best shown in FIGS. 15 to 17, the sliding bed 56 has first and second vertical portions **56*a* and 56*b* spaced from one another, between which the head 58' is slidably disposed on the sliding bed 56. The compression spring 72 is disposed on the bolt 60 at a position between the vertical portion 56*b* and the head 58' to urge the head 58' rightward as viewed in FIGS. 14 to 17. With this arrangement, when the bolt 60 is turned from a position shown in FIG. 15 to a position shown in FIG. 16, the head 58' is pulled leftward against the force of the compression spring 72 so that the sliding bed 56 is moved leftward by the action of the spring 72. This raises the pressing bed 70 upward, thereby resiliently supporting the partition wall or window frame assembly (not shown) to the ceiling. FIG. 17 shows a state in which the pression bed 70** is positioned in its upper most location.

It will now be apparent from the foregoing description that in accordance with the present invention the partition wall fastening unit can be readily put into a practical application to fasten a partition wall between a ceiling and a floor with the durable and satisfactory performance without requiring any prior work applicable to houses or buildings, and can be easily removed without remaining any ugly appearance on any part of houses or buildings. Further, it will be apparent from the foregoing description that the partition wall fastening unit in accordance with the present invention allows a wide variely of layout with a less expense for application and removal.

Although the above description is concentrated on the case where the partition wall fastening unit is mounted in the recess 25 defined on top of the partition wall 21, the partition wall fastening unit may be fitted in a recess defined at the bottom of the partition wall 21. It is also possible to apply 2 sets of the partition wall fastening units to be fitted both on top of and at the bottom of the partition wall 21. Further, although the above description is concentrated on the case where the partition wall fastening unit is mounted in a recess 25 defined in the partition wall 21, the partition wall fastening unit may be manufactured integrally with the partition wall 21.

While the present invention has been particularly shown and described with reference to preferred embodiments thereof, it will be understood that various changes and modifications may be made without departing from the scope of the present invention.

Figure 18:
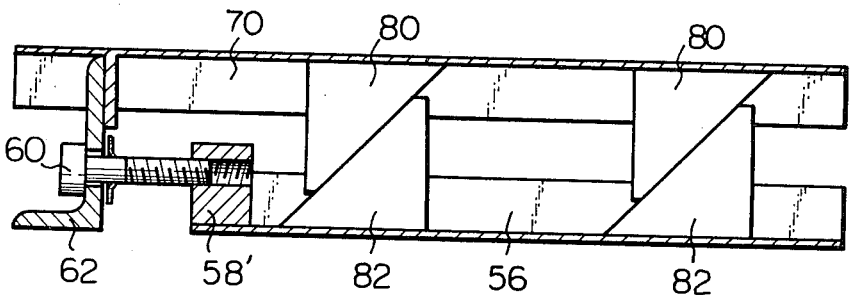
FIGS. 18 and 19 are cross sectional views of modified forms of a partition wall fastening unit of the present invention.
Figure 19:
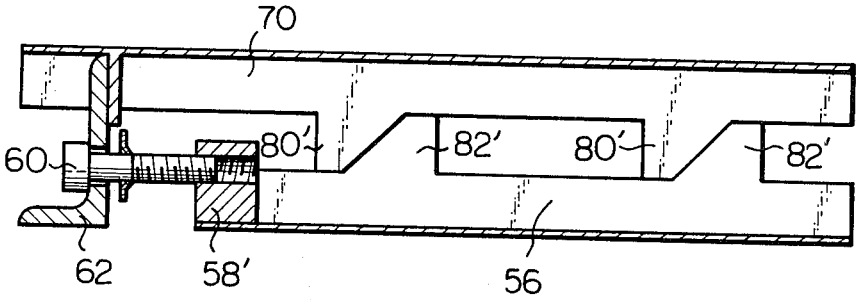

For example, the connecting links connected between the sliding bed and the pressing bed may be replaced with sliding blocks 80 mounted on the inner surface of the pressing bed 70 and sliding blocks 80 mounted on the sliding bed 56 as shown in FIG. 18. The sliding blocks 80 and 82 may be integrally formed with the pressing bed 70 and the sliding bed 56 as indicated at 80' and 82' in FIG. 19.

What is claimed is:

1. A partition wall fastening unit for fixing a partition wall between a ceiling and a floor of a building construction, comprising:

a lower frame including a bottom wall having its lower surface secured to an upper end of said partition wall;

an upper frame vertically slidably disposed in said lower frame;

a sliding bed slidably disposed on an upper surface of the bottom wall of said lower frame;

a first bracket secured to an end of said sliding bed and horizontally movable with said sliding bed;

a second bracket secured to one end of said lower frame on the same plane as said first bracket;

a pressing bed vertically movably disposed in said lower frame between said sliding bed and said upper frame, said pressing bed being connected to and supporting said upper frame and being vertically movable with said upper frame;

a plurality of links connected between said sliding bed and said pressing bed; and a drive mechanism including a bolt rotatably supported by said second bracket, said bolt including a threaded end screwed into said first bracket to move said sliding bed on the upper surface of said bottom wall of said lower frame in a horizontal direction, whereby said pressing bed is vertically movable within said lower frame relative to the bottom wall of said lower frame and accordingly said upper frame is moved relative to said ceiling.

2. A partition wall fastening unit according to claim 1, further comprising a spacer attached to an upper surface of said upper frame.

3. A partition wall fastening unit according to claim 1, further comprising means for resilienty supporting said upper frame on said pressing bed.

4. A partition wall fastening unit for fixing a partition wall between a ceiling and a floor of a building construction, comprising:

a lower frame including a bottom wall having its lower surface secured to an upper end of said partition wall;

an upper frame vertically slidably disposed in said lower frame;

a sliding bed slidably disposed on an upper surface of the bottom wall of said lower frame;

a first bracket secured to an end of said sliding bed and horizontally movable with said sliding bed;

a second bracket secured to one end of said lower frame on the same plane as said first bracket;

a pressing bed vertically movably disposed in said lower frame between said sliding bed and said upper frame, said pressing bed being connected to and supporting said upper frame and being vertically movable with said upper frame;

a plurality of compression springs disposed between said upper frame and said pressing bed to yieldingly urge said upper frame relative to said ceiling.

a plurality of links connected between said sliding bed and said pressing bed; and a drive mechanism including a bolt rotatably supported by said second bracket, said bolt including a threaded end screwed into said first bracket to move said sliding bed on the upper surface of said bottom wall of said lower frame in a horizontal direction, whereby said pressing bed is vertically movable within said lower frame relative to the bottom wall of said lower frame and accordingly said upper frame is moved relative to said ceiling.

* * * * *